US008347565B2

(12) United States Patent
Carroll

(10) Patent No.: US 8,347,565 B2
(45) Date of Patent: Jan. 8, 2013

(54) SOLAR PANELS FIXTURES AND INSTALLATIONS

(76) Inventor: Min Carroll, Montgomery, IL (US)

( * ) Notice: Subject to any disclaimer, the term of this patent is extended or adjusted under 35 U.S.C. 154(b) by 0 days.

(21) Appl. No.: 13/539,208

(22) Filed: Jun. 29, 2012

(65) Prior Publication Data

US 2012/0298597 A1 Nov. 29, 2012

(51) Int. Cl.
*E04D 13/18* (2006.01)

(52) U.S. Cl. ..... 52/173.3

(58) Field of Classification Search ..... 211/189, 211/13.1, 41.1, 26; 52/173.3; 126/621–623; 136/244, 251
See application file for complete search history.

(56) References Cited

U.S. PATENT DOCUMENTS

| | | | | |
|---|---|---|---|---|
| 4,189,881 | A * | 2/1980 | Hawley | 52/91.3 |
| 5,571,338 | A * | 11/1996 | Kadonome et al. | 136/251 |
| 6,155,006 | A * | 12/2000 | Mimura et al. | 52/173.3 |
| 6,672,018 | B2 * | 1/2004 | Shingleton | 52/173.3 |
| 6,959,517 | B2 | 11/2005 | Poddany et al. | |
| 7,888,588 | B2 | 2/2011 | Shingleton | |
| 7,971,398 | B2 | 7/2011 | Tweedie | |
| 8,061,091 | B2 | 11/2011 | Botkin et al. | |
| 8,156,697 | B2 | 4/2012 | Miros et al. | |
| 8,205,400 | B2 | 6/2012 | Allen | |
| 8,209,920 | B2 | 7/2012 | Krause et al. | |
| 2003/0101662 | A1 * | 6/2003 | Ullman | 52/27 |
| 2004/0000334 | A1 * | 1/2004 | Ressler | 136/251 |
| 2005/0115176 | A1 * | 6/2005 | Russell | 52/220.1 |
| 2006/0032527 | A1 * | 2/2006 | Stevens et al. | 136/251 |
| 2008/0087320 | A1 * | 4/2008 | Mapes et al. | 136/244 |
| 2009/0242014 | A1 * | 10/2009 | Leary | 136/251 |
| 2010/0077680 | A1 * | 4/2010 | Banister | 52/173.3 |
| 2010/0313501 | A1 * | 12/2010 | Gangemi | 52/173.3 |
| 2012/0031018 | A1 | 2/2012 | Kapany | |
| 2012/0036799 | A1 | 2/2012 | Kneip et al. | |
| 2012/0137600 | A1 | 6/2012 | Jenkins | |
| 2012/0144763 | A1 | 6/2012 | Antonic | |

* cited by examiner

*Primary Examiner* — Jennifer E. Novosad

(57) ABSTRACT

The edge fixtures are designed to clip at least two edges of at least one solar panel and corner fixtures are designed to clip to each corner of at least one solar panel. These fixtures can be made by casting mold that can use materials of aluminum or aluminum alloys, or made by injection molding using plastic materials. The examples show the edge fixtures and the corner fixtures having flexible features to fix or install on any desired angle surface with various supporting members such as frame members and cross brace members which can be shaped as polygon or use angle aluminum or angle aluminum alloy or angle iron or angle steel etc. These fixtures and supporting members can be installed on the ground or attached to additional structures such as roofs of buildings etc. for residential, commercial and industrial users.

28 Claims, 12 Drawing Sheets

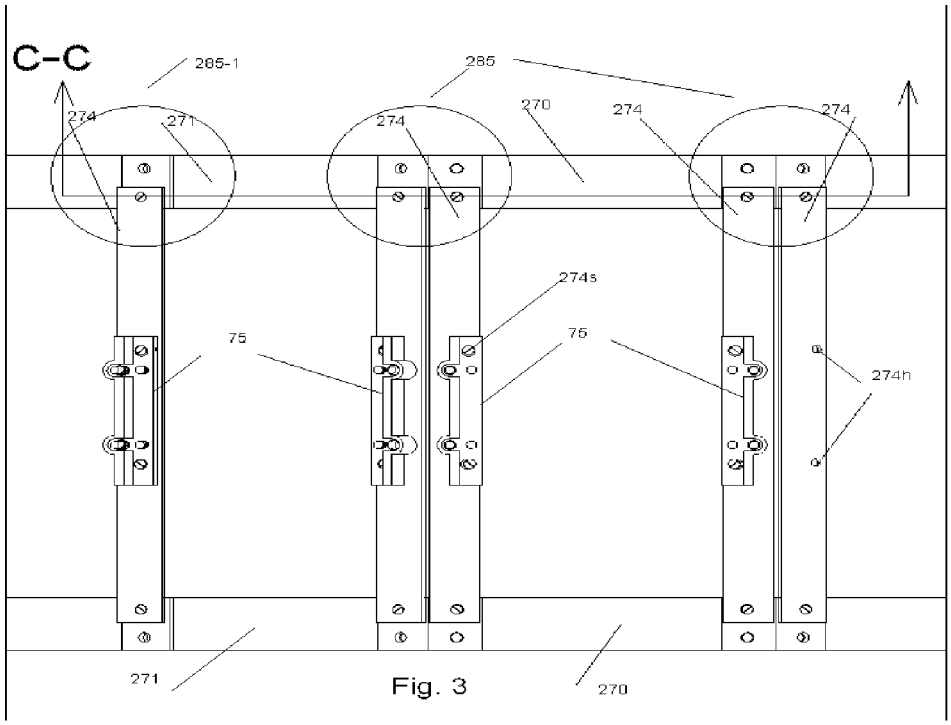
Fig. 3
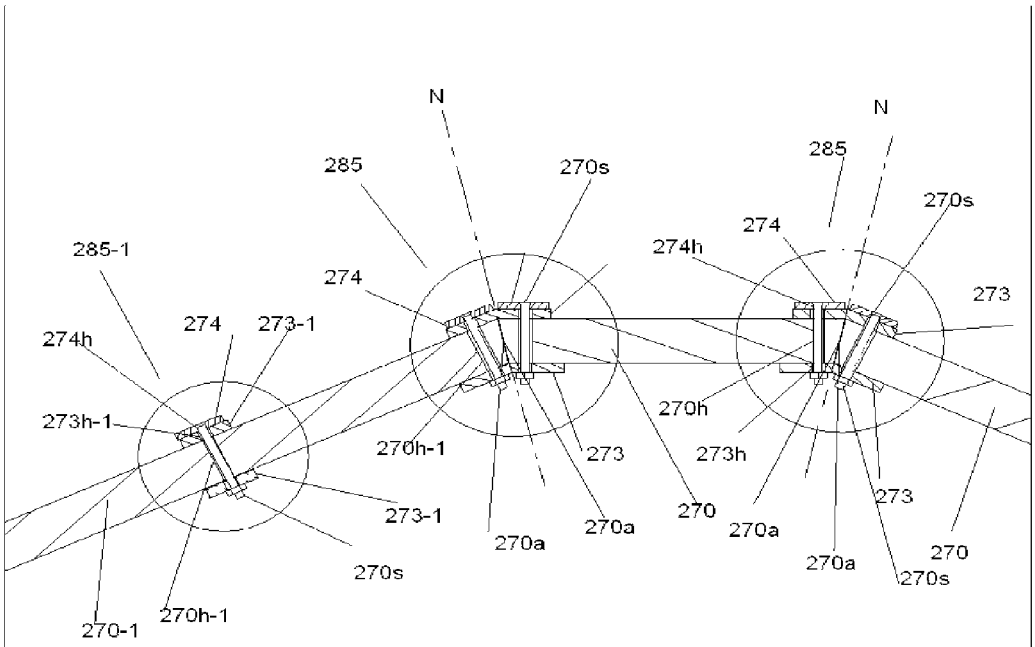
Fig. 3 c-c

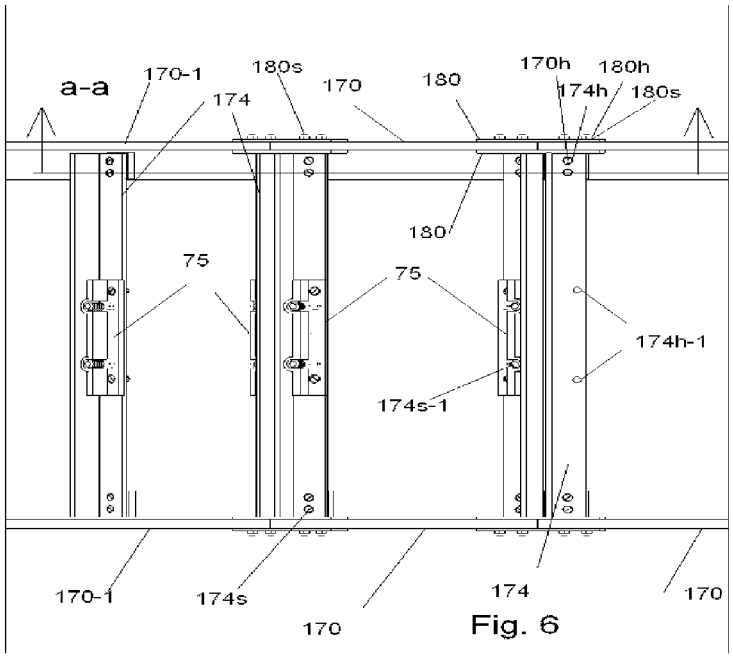
Fig. 6
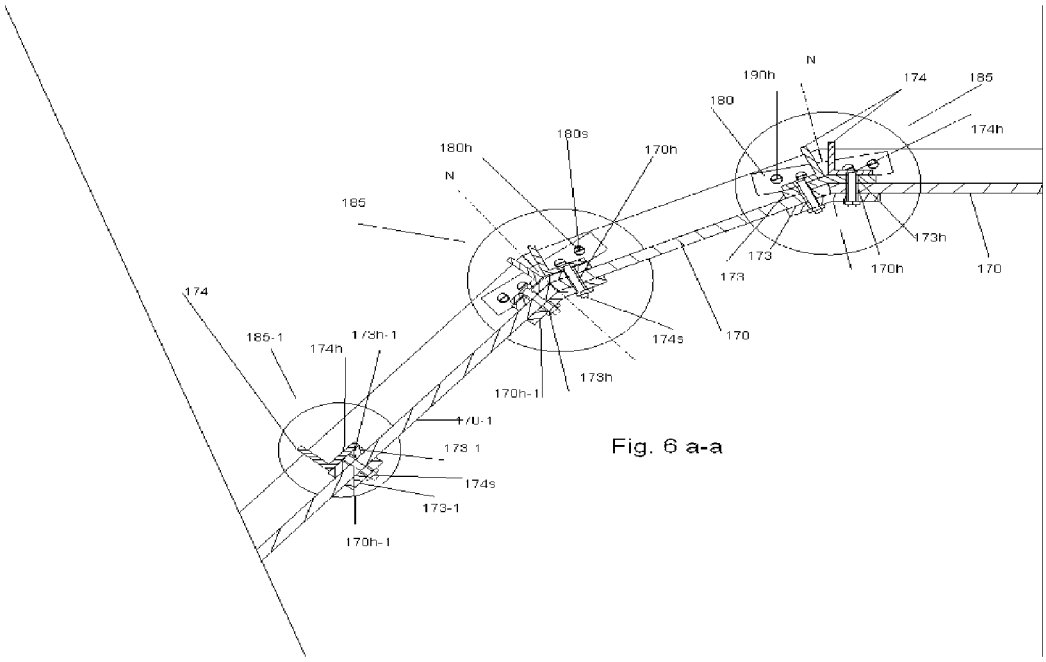
Fig. 6 a-a

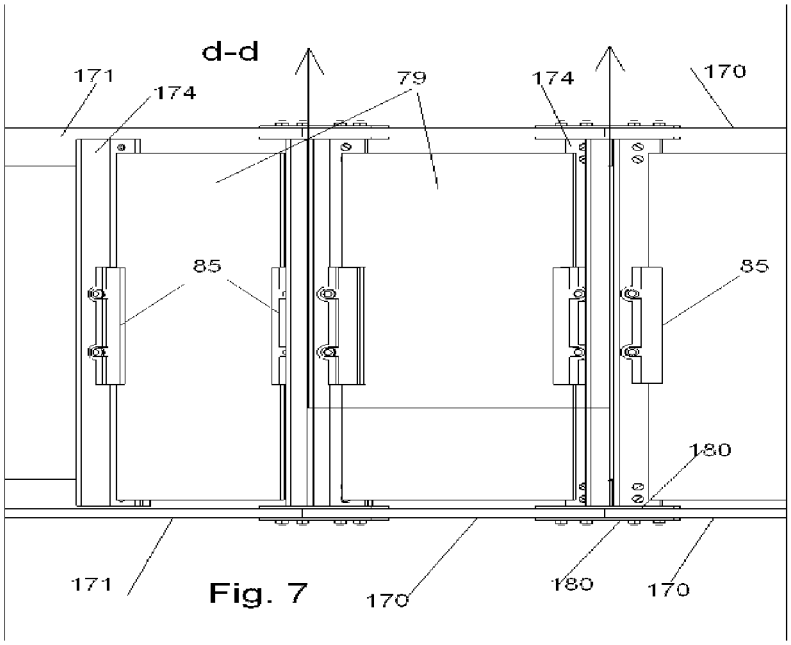
Fig. 7
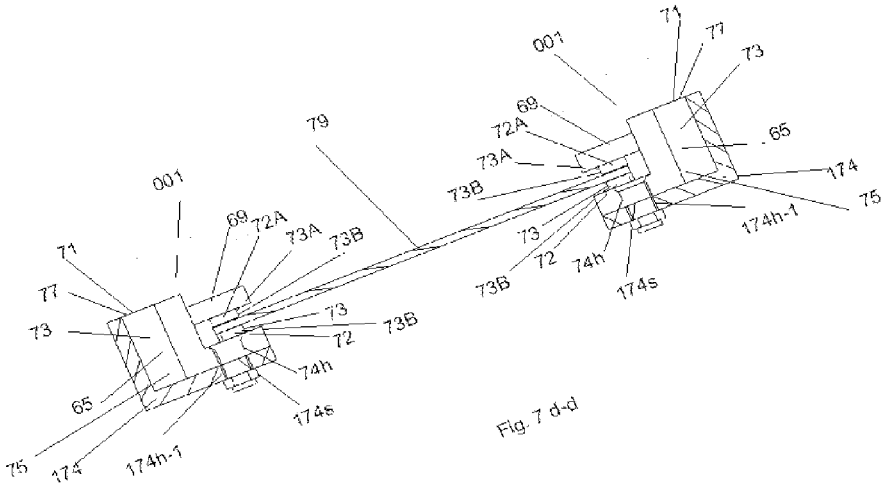
Fig. 7 d-d

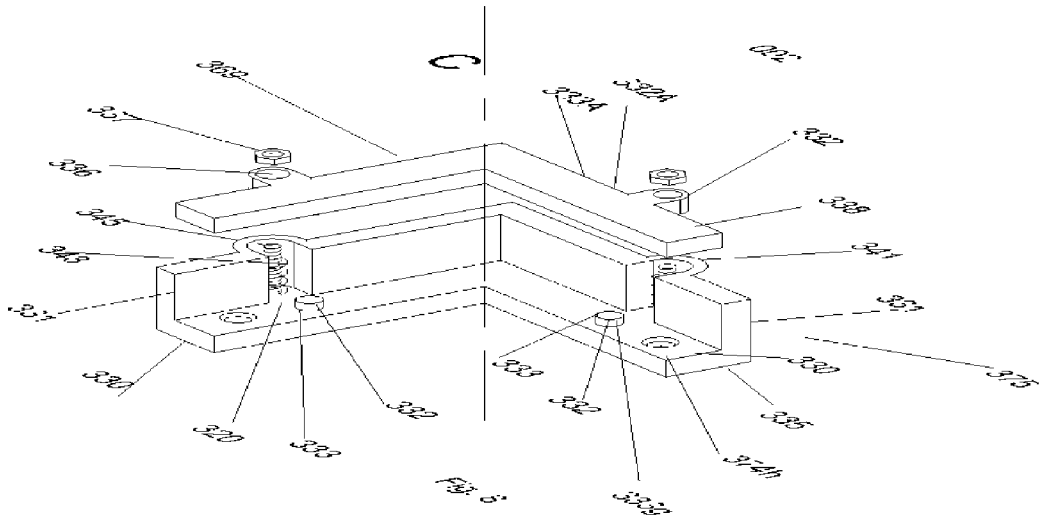
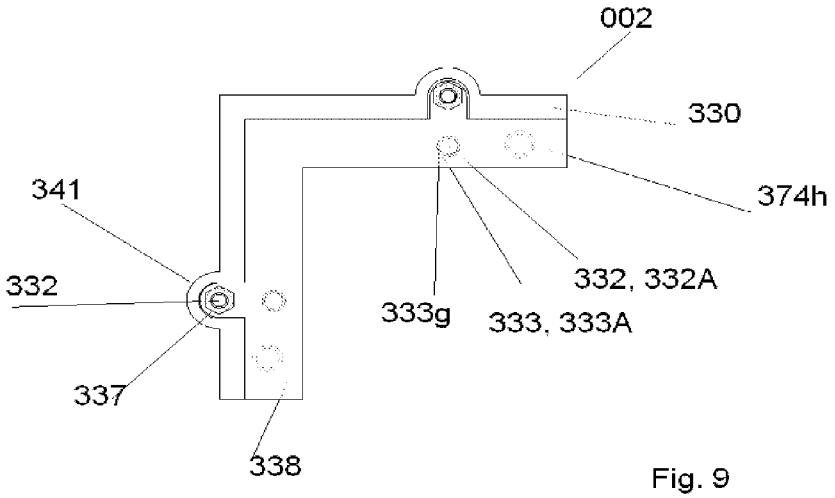
Fig. 9

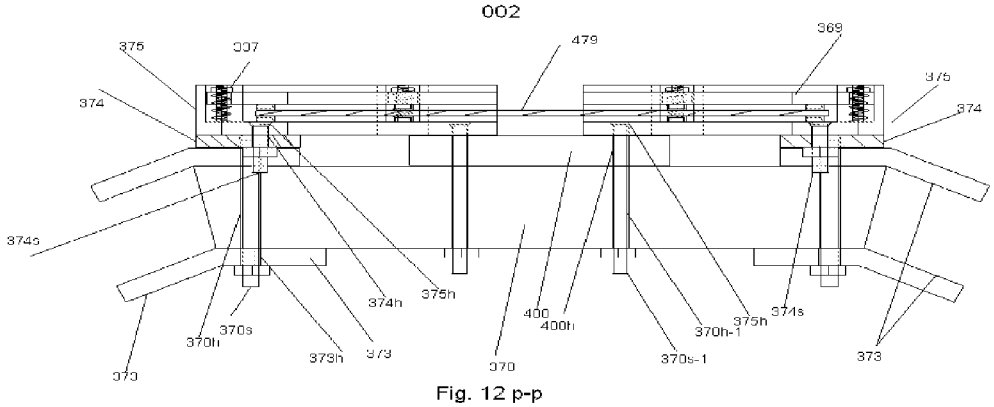
Fig. 12 p-p

SOLAR PANELS FIXTURES AND INSTALLATIONS

BACKGROUND OF THE INVENTION

The present invention relates using fixing apparatus to install at least one solar panel, more particularly to utilize fixing apparatus to install at least one solar panel to additional support members to achieve a wide range of usage of solar energy when these fixing apparatus are employed.

Reduce cost of energy for residential, commercial and industrial users is critical. Using either thin film or crystalline silicon solar panels to generate electricity or to charge batteries or battery packs or other usage require fewer procedures in comparison to other types of energy. Since solar panel is light-weight and easy to use, it has a great potential for a wide range of uses.

The prior arts shown that the solar panel or photovoltaic module or kit installation or methods of assembly require complex production lines and assembly procedures which are less likely to be extensively use.

The present invention simplifies fabrication of edge fixtures and corner fixtures and reduces assembly or installation procedures to operate with various support members that are required by thin film or crystalline solar panels. The edge fixtures and corner fixtures can be employed by support members such as frame members and cross brace members or building structures, etc. The examples show these fixtures having flexible features to fix or install on any given angle surface with various supporting members which solve the problems of narrow usage of solar panel generated power. The edge fixtures and corner fixtures installed with various supporting members widen or increase the usage of solar energy which suit for residential, commercial and industrial users.

BRIEF DESCRIPTION OF THE DRAWINGS

FIG. 3 *c-c* is a portion section view of FIG. 3.

FIG. 5*k*-1 is an isometric view of FIG. 5*k* with additional pedestals of edge fixtures and additional supporting members.

FIG. 5*k*-2 is an isometric view of the second example that attached at least two sets of the edge fixtures, and at least one solar panel.

FIG. 5*k*-3 is a front view of FIG. 5*k*-2 with a horizontal installation of the at least two sets of the edge fixtures and the at least one solar panel.

FIG. 5*k*-4 is a front view of at least two edge fixtures 001 attached at least one solar panel with a desired angle layout.

FIG. 5*k*-5 is a top view of FIG. 5*k*-4 without top covers of the edge fixtures 001 and the at least one solar panel.

FIG. 5*k*-6 is a top view of FIG. 5*k*-4.

FIG. 6 is a top view of a third example of at least two pedestals of edge fixtures installed with different supporting members.

FIG. 6 *a-a* is a front section view of FIG. 6.

FIG. 7 is a top view of FIG. 6 attached at least two sets of edge fixtures and at least one solar panel.

FIG. 7 *d-d* is a front section view of FIG. 7.

FIG. 8 is an isometric view of a set corner fixture 002.

FIG. 9 is a top perspective view of FIG. 8.

FIG. 12 *p-p* is a perspective view of top section view of FIG. 11.

DETAILED DESCRIPTION OF DRAWINGS

Figure 1:
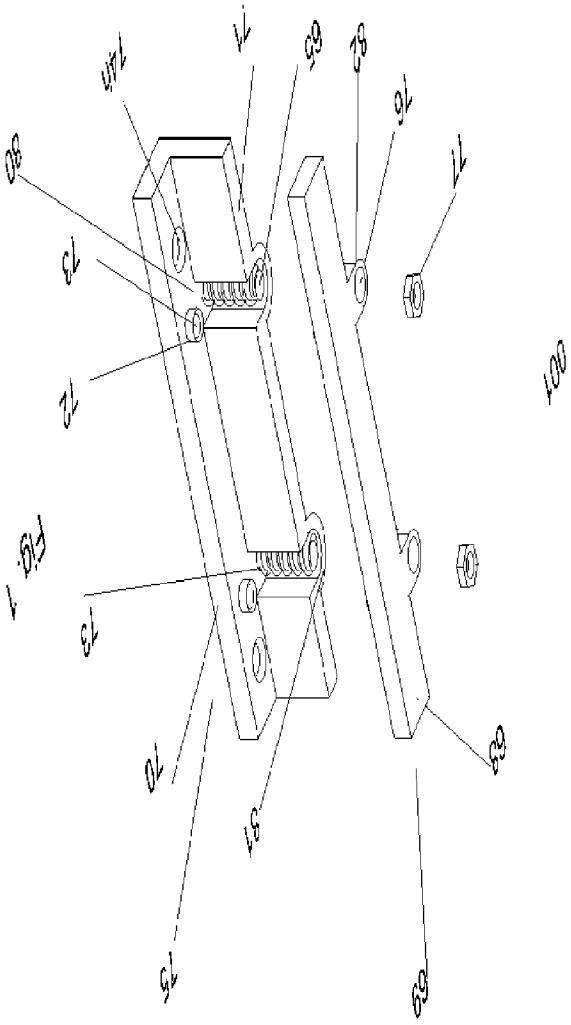
FIG. 1 is a trimetric view of a set of edge fixture 001 without attachment of a solar panel.
Figure 2:
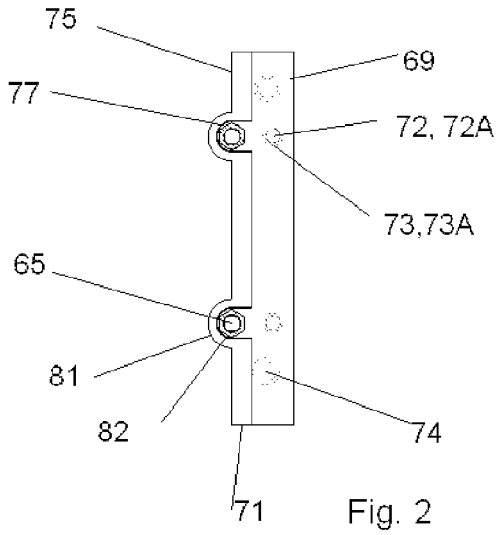
FIG. 2 is a top perspective view of the FIG. 1.
Figure 4:
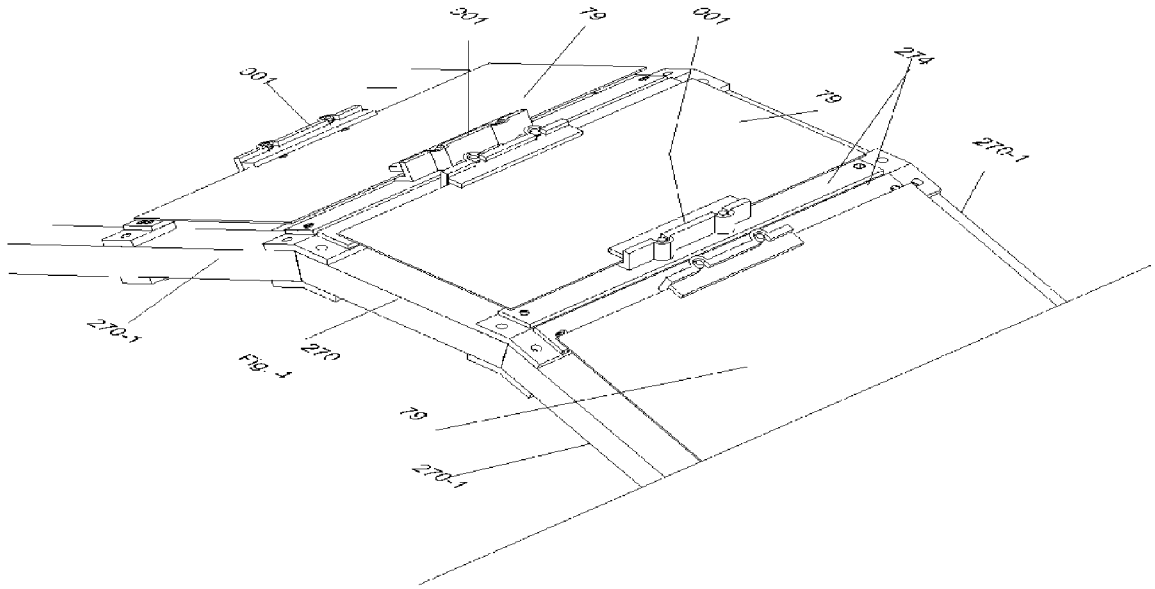
FIG. 4 is an isometric view of the FIG. 3 which attached at least two edge fixtures 001 that installed on the supporting members for at least one solar panel.
Figure 4A:
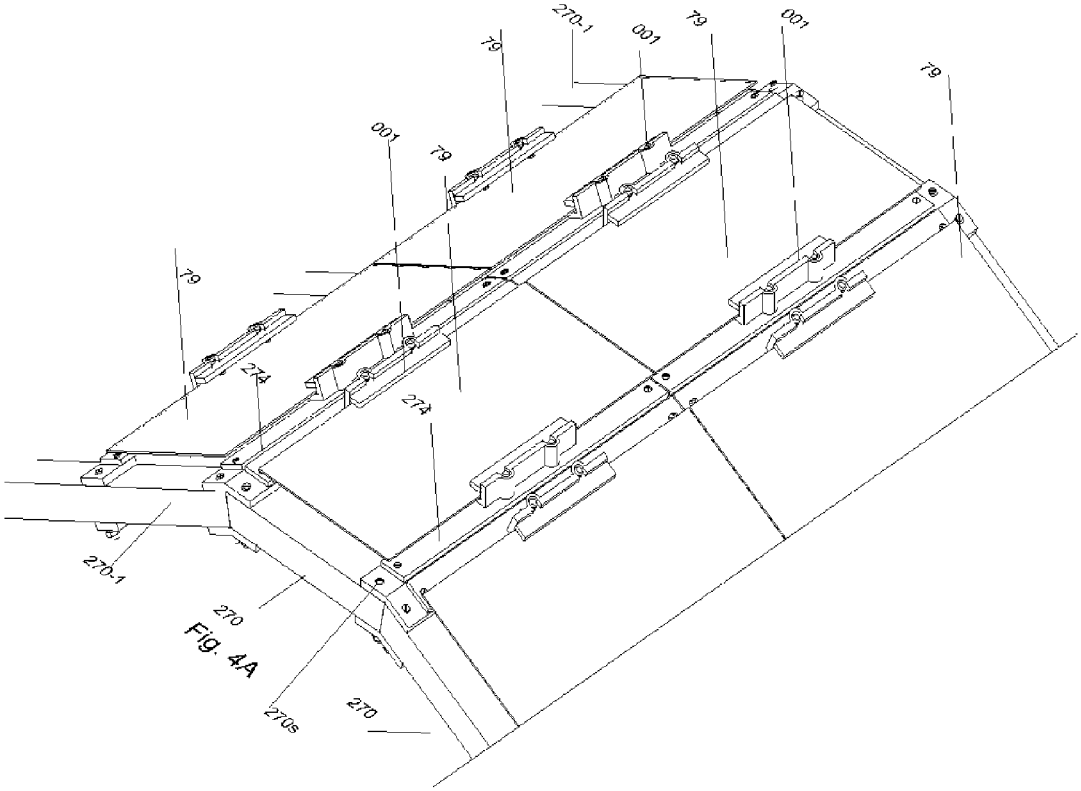
FIG. 4A is an isometric view of FIG. 4 with additional edge fixtures 001, additional supporting members and additional solar panels.
Figure 5:
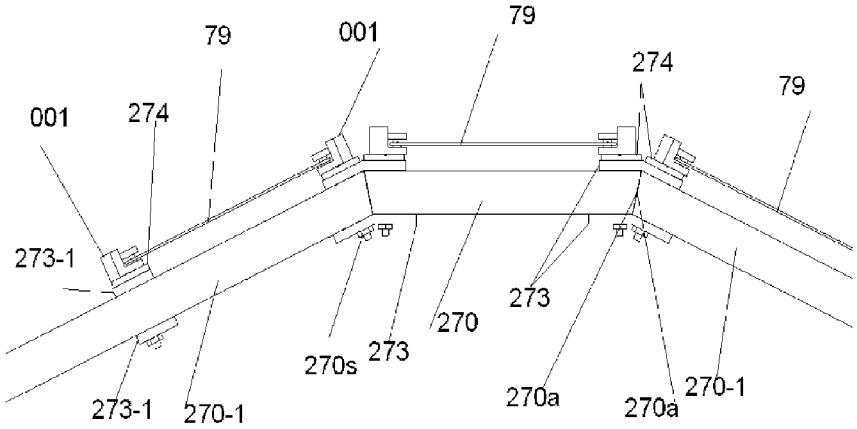
FIG. 5 is a front view of FIG. 4 or FIG. 4A.
Figure 6K:
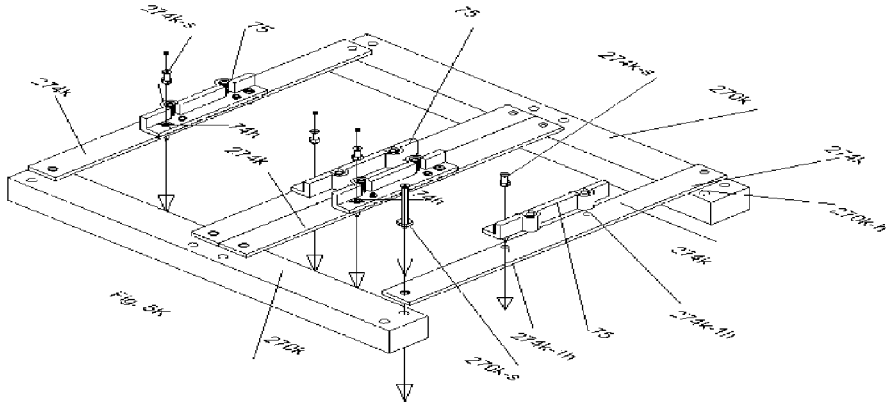
Figures 1, 5K:
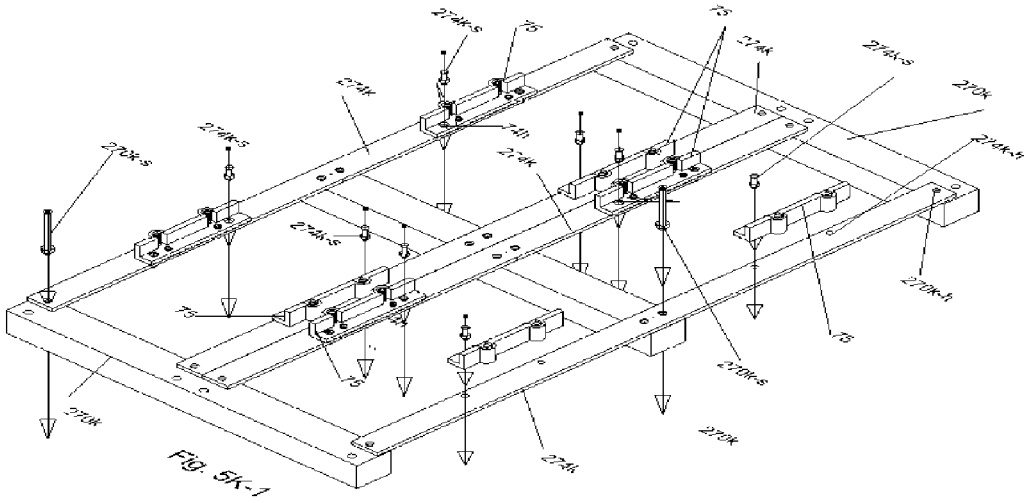
FIG. 5*k* is an isometric view of a second example that attached at least two pedestals of edge fixtures with a plurality of different supporting members.
Figures 2, 5K:
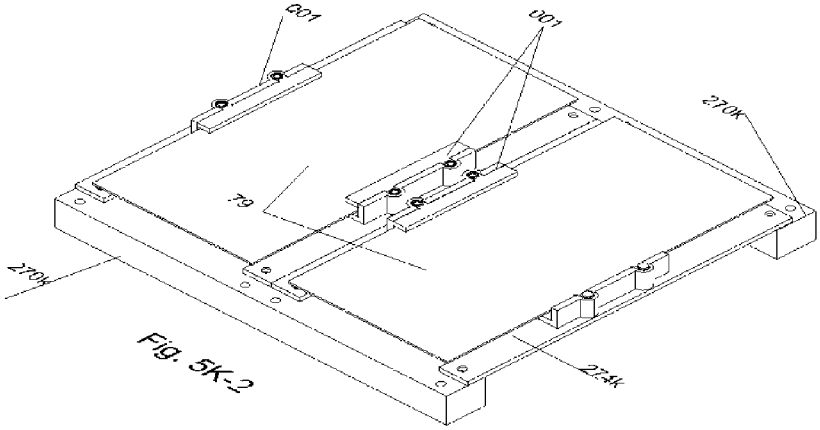
Figures 3, 5K:
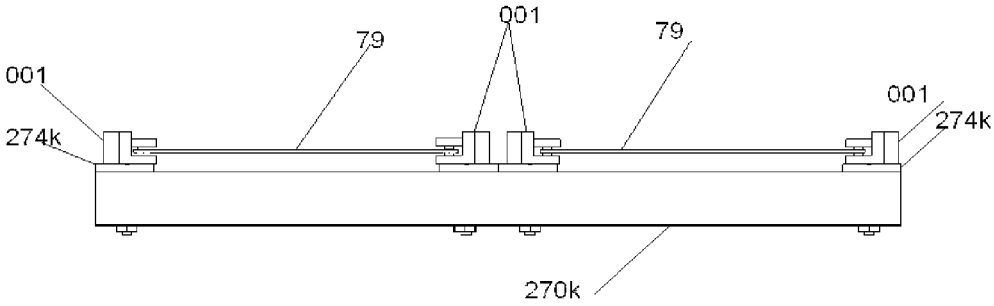
FIG. 3 is a top perspective view of a first example that attached at least two pedestals of edge fixtures with a plurality of supporting members.
Figures 4, 5K:
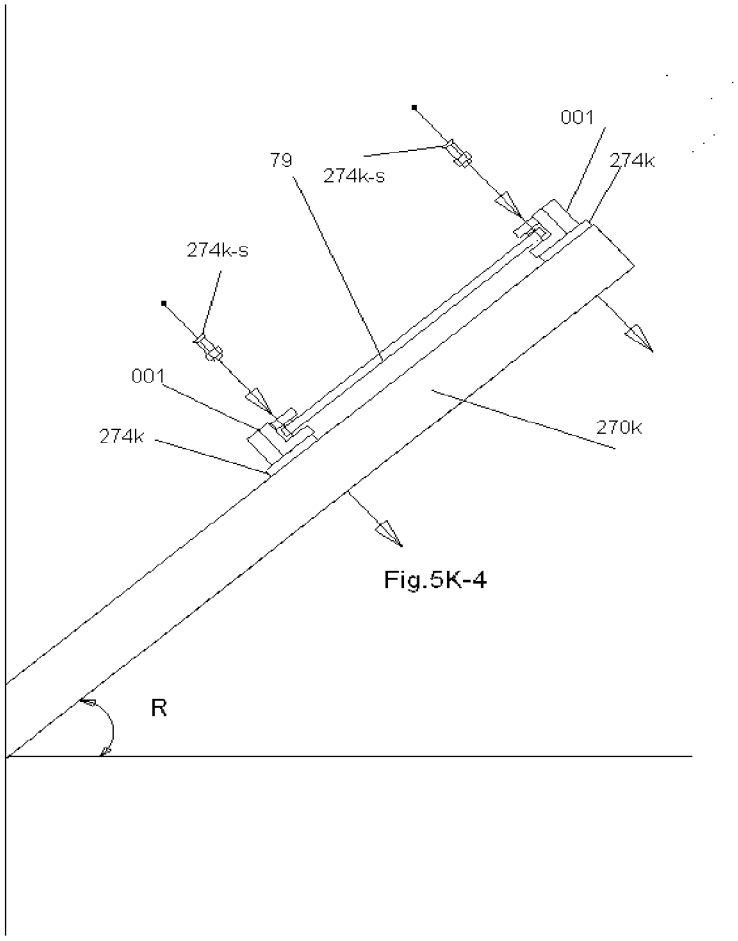
Figures 5, 5K:
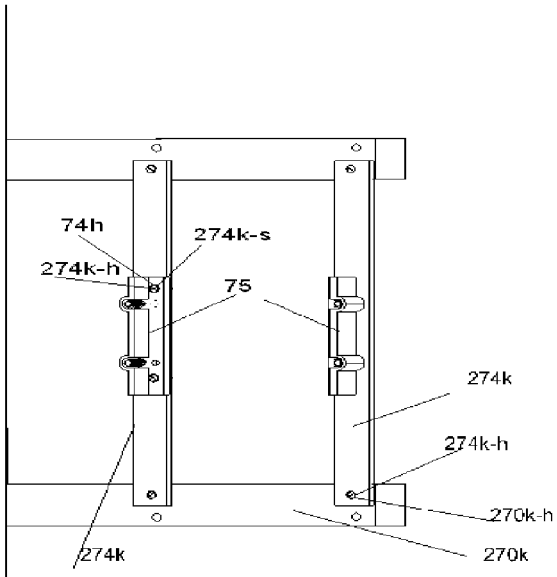

Referring to FIG. 1, FIG. 2, FIG. 3, a section view FIG. 3 *c-c*, FIG. 4, FIG. 4A and FIG. 5, a first example of an embodiment of solar panel edge fixtures installations or assembly comprise at least one thin film solar panel or crystalline silicon solar panel 79, at least two sets of edge fixtures 001 which designed to clip the edges of the at least one solar panel 79, and configuration of holes and/or angles to supporting members of at least two cross brace members and at least two frame members, and included a plurality of secure members such as plates and fasteners according to the invention.

The at least two edge fixtures 001 are each comprised a pedestal 75, that can be made by casting mold using materials of aluminum or aluminum alloys, or can be made by injection molding using plastic materials, configuring a horizontal rectangular stand 70 built in at least two flanges 72 placed evenly around central axis and positioned at the upper surface of the rectangular stand 70; the rectangular stand 70 is built with at least two installation holes 74*h*, that positioned evenly around the central axis of the horizontal rectangular stand 70, which can be attached or installed with an additional support members or a structure on the ground or roof of a building etc; a vertical rectangular stand 71 perpendicularly conjoins to an edge of the horizontal rectangular stand 70 and opens to at least two slots 80 to conjoin to at least two semi-hollow cylinders 81 which extend to the edge of the horizontal rectangular stand 70, the at least two semi-hollow cylinders 81 placed perpendicularly from the upper surface of the rectangular stand 70; a built in screw pole 65 placed to the center of each semi-hollow cylinder 81 and perpendicularly positioned from the upper surface of the rectangular stand 70; a reinforced strength spring 73 placed on each screw pole 65 positioned as the same central axis of the screw pole 65.

The at least two edge fixtures 001 are each comprised at least one top cover 69, that can be made by casting mold using materials of aluminum or aluminum alloys, or can be made by injection molding using plastics materials, configured a top horizontal rectangular stand 68 substantially similar to the horizontal rectangular stand 70, at least two built in semi-cylinders 82 extended to and positioned evenly from a central axis of an edge of the horizontal rectangular stand 68, at least two built in threaded holes 76 are each positioned at the same central axis as the semi-cylinders 82, at least two built in flanges 72A are each positioned at the bottom surface of the top horizontal rectangular stand 68 aligned the same central axis and corresponding to the flanges 72 of the horizontal rectangular stand 70; the top cover 69 can be moved up or down along the slots 80 tightened with at least two screw poles 65 and at least two bolts 77. Each edge fixture 001 comprises at least four identical rubber flanges 73 or 73A that each can be fitted and bound with glue 73*g* into the flange 72 or 72A. The at least two sides of the at least one solar panel 79 mounted between the rubber flanges 73A of the top covers and the rubber flanges 73 of the pedestals.

At least two frame members 270 or 270-1 are each parallel positioned on a side of at least one thin film solar panel or crystal silicon solar panel 79, and at least two cross brace members 274 are perpendicularly to connect the at least two frame members at each corner of the at least one solar panel 79. Each frame member 270 or 270-1 configures at least one hole 270*h* at each corner of the at least one solar panel 79, and trimmed a desired angle 270*a* at both ends or one end of the frame member 270 or 270-1. The at least two cross brace member 274 are each configured at least one hole 274*h* that correspond to each corner of the at least one solar panel 79, at least one set of fastener 270*s* including a screw and a bolt tightened perpendicularly through the at least one hole 274*h* of the cross brace member 274 which is positioned at the top of a half first joint 285 which identified by a junction axis N, at least one hole 273*h* of a half first bent angle plate 273, the at least one hole 270*h* of the frame member 270, the at least one hole 273*h* of a half second bent angle plate 273 which is located at bottom of the half first joint 285. The two bent angle plates 273 placed at each of the first joints 285 which matched the same angle as formed by the two frame members 270 or the two frame members 270 and 270-1, each bent angle plate 273 placed at least one hole 273*h* on opposite of a junction axis N which correspond to two corners of two solar panels 79. At each of second joints 285-1, at least one set of fastener including a screw and a bolt perpendicularly tighten through the at least one hole 274*h* of the cross brace member, at least one hole 273*h*-1 of a first flat plate 273-1, the at least one hole 270*h*-1 of the frame member 270-1. At least one hole 273*h*-1 of a second flat plate 273-1 is an optional to attach at the bottom of the second joint 285-1.

The at least two cross brace members 274 are each included at least two installation holes 274*h*-1 placed evenly around a central axis of the cross brace member 274 which correspond to at least two installation holes 74*h* of the pedestal 75. At least two sets of fasteners 274*s* are each included a screw and a bolt to tighten through the at least two installation holes 74*h* of each pedestal 75 and the at least two holes 274*h* of each cross brace member 274. The at least two sets of the pedestals 75 are parallel positioned to each other on both sides of the at least one solar panel 79 and clipped at least two sides of the at least one solar panel 79 through the flanges 73, 72 and 73A, 72A and pressured by the top covers 69, tightened by the screw poles 65 and bolts 77, reinforced strength by the springs 73.

In the situation of configuration of a massive array of solar panels 79, the FIG. 4A shows some features of the edge fixtures 001 and installations by adding more of the edge fixtures 001, frame members 270 and 270-1 and cross brace members 274.

The first example of embodiment shows that the at least two cross brace members and the at least two frame members are each can be shaped as polygon such as rectangular or square or six sides polygon.

Referring FIG. 5K, FIGS. 5K-1, FIGS. 5K-2, FIGS. 5K-3, FIGS. 5K-4, FIGS. 5K-5, FIGS. 5K-6, a second example of an embodiment uses at least two edge fixtures 001, selected rectangular or square cross brace members 274*k* and the frame members 270*k* that connect perpendicularly without trimming an angle at the ends of the supporting members. The solar panel edge fixtures installations comprise at least one thin film solar panel or crystalline silicon solar panel 79, at least two sets of edge fixtures 001 which are designed to clip the edges of the at least one solar panel 79, and configurations of holes to supporting members of at least two cross brace 274*k* and at least two frame members 270*k*, and include a plurality of secure members such as plates and fasteners according to the invention. The at least two edge fixtures 001 are included in this embodiment, the detail configurations of the edge fixture 001 described above which are not repeated herein in this example.

At least two frame members 270*k* are each parallel positioned on a side of at least one thin film solar panel or crystal silicon solar panel 79, and at least two cross brace members 274*k* are each parallel positioned and perpendicularly to connect to the at least two frame members at each corner of the at least one solar panel 79, each frame member 270*k* or cross brace member 274*k* configured to at least one hole 270*k-h* or 274*k-h* at each corner of the at least one solar panel 79, to tighten with at least one fastener 270*k-s* which includes a screw and a bolt. The at least two cross brace members 274*k* are each configured at least two holes 274*k*-1*h* evenly around the central axis of the cross brace member 274*k* and corresponding to the at least two holes 74*h* of each edge fixture 001 to tighten with at least two fasteners 74*s* are each including a screw and a bolt. At least two sides of the at least one solar panel 79 mounted between the rubber flanges 73A of the top covers and the rubber flanges 73 of the pedestals. The at least two sets of the pedestals 75 are parallel positioned to each other on both sides of the at least one solar panel 79 and clipped at least two sides of the at least one solar panel 79 through the flanges 73, 72 and 73A, 72A and pressured by the top covers 69, tightened by the screw poles 65 and bolts 77, reinforced strength by the springs 73.

Figures 5, 5K, 6:
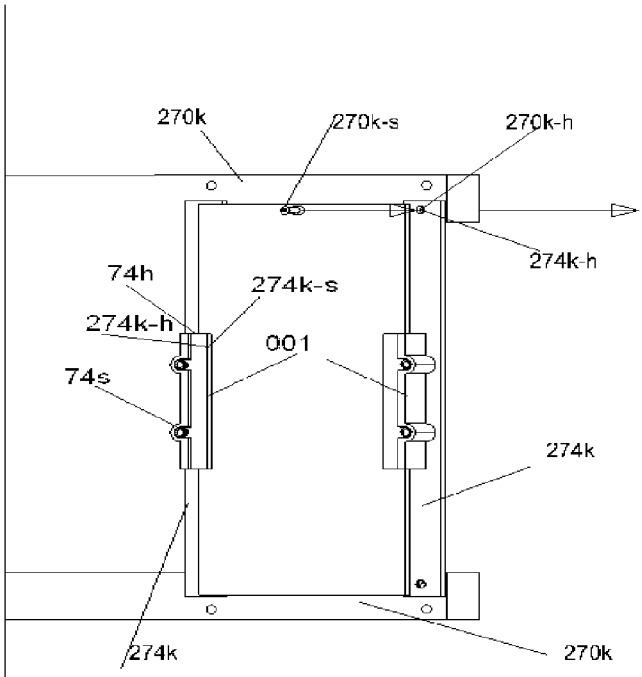
Figure 10:
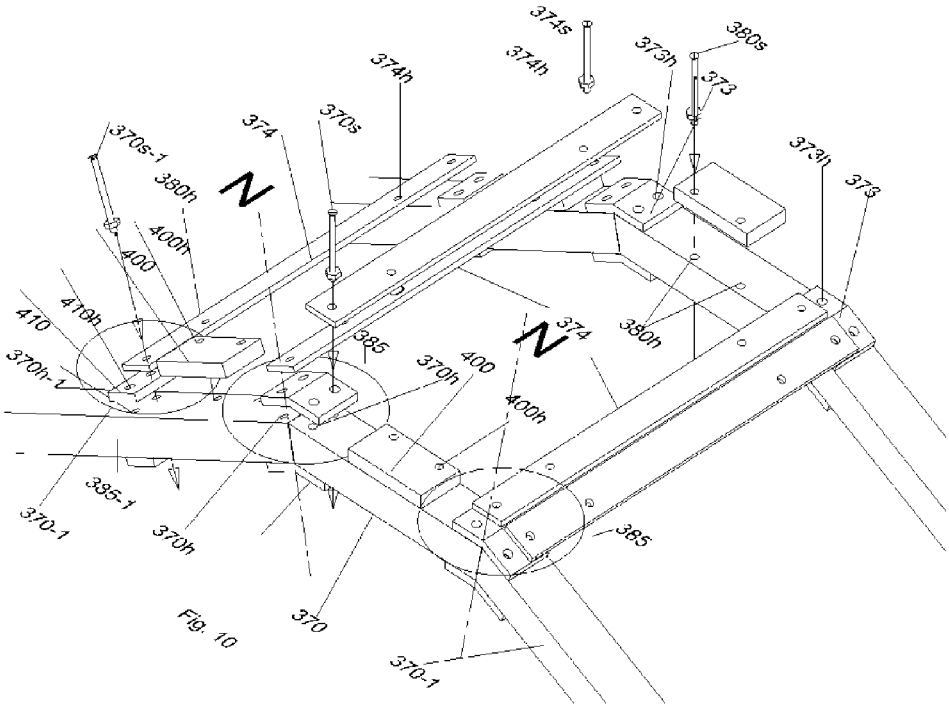
FIG. 10 is an isometric view of a fourth example that a plurality of supporting member which substantially similar to the supporting members of the first example.
Figure 11:
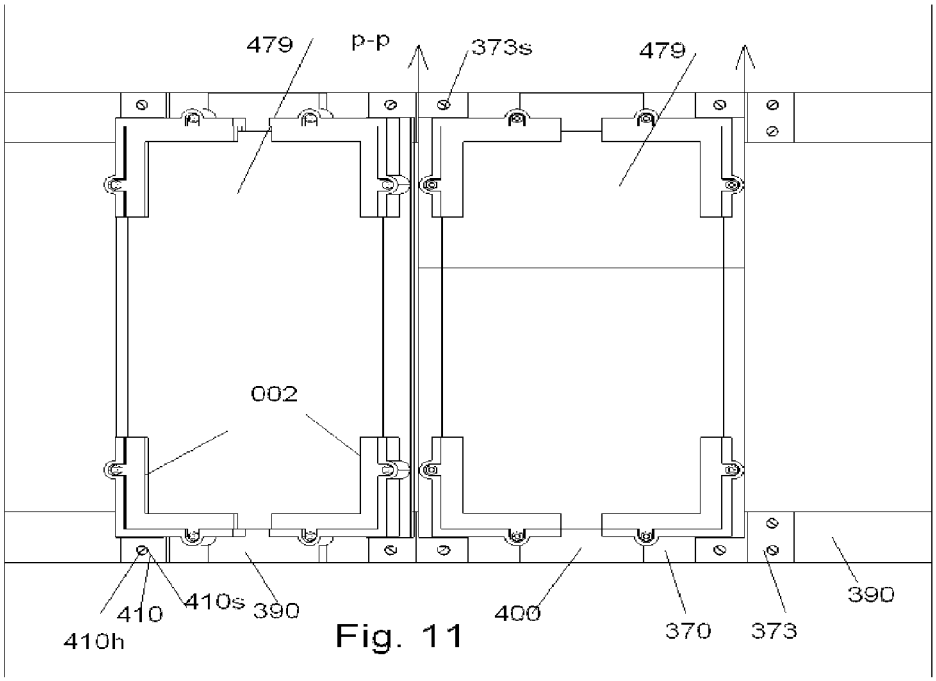
FIG. 11 is a top view of FIG. 10 attached at least four sets of corner fixtures 002 and at least one solar panel.

Referring FIGS. 5K-5, FIG. 5K-6, the at least two frame members 270*k* and the at least two cross brace members 274*k* can support at least one solar panel 79 and at least two edge fixtures 001; or the at least two frame members 270*k* and the at least two cross brace members 274*k* can support more than one solar panels 79 and more than two edge fixtures 001, referring to FIG. 5K, FIG. 5K-1 and FIG. 5K-2, each solar panel 79 requiring at least two edge fixtures 001 are each parallel positioned to each other and clipped to a side of the solar panel 79. Referring to FIGS. 5K-3 and FIGS. 5K-4, the at least one solar panel 79 installed on the supporting members which can be raised at a desired angle including a horizontal level.

The second example of embodiment shows that the at least two cross brace members and the at least two frame members are each can be shaped as polygon such as rectangular or square or six sides polygon.

Referring to FIG. 6, FIG. 6 *a-a*, FIG. 7 and FIG. 7 *d-d*, a third example of an embodiment uses at least two edge fixtures 001, selected standardizing or special made angle aluminum or angle aluminum alloy or angle iron or angle steel for cross brace members 174 and/or the frame members 170 and 170-1. The solar panel edge fixtures installations comprise at least one thin film solar panel or crystalline silicon solar panel 79, at least two sets of edge fixtures 001 which are designed to clip at least two edges of the at least one solar panel 79, and configuration of holes and/or angles to supporting members of the at least two cross brace members and the at least two frame members, and include a plurality of secure members such as plates and fasteners according to the invention.

At least two edge fixture 001 included in this third example embodiment, the configuration of each edge fixture 001 is the same or substantially similar as described above and shown in the FIG. 1 and FIG. 2. Each edge fixture 001 comprises a pedestal 75, that can be made by casting mold using materials of aluminum or aluminum alloys, or can be made by injection molding using plastic materials, configuring a horizontal rectangular stand 70 built in at least two flanges 72 placed evenly around a central axis and positioned at the upper surface of the rectangular stand 70; the rectangular stand 70 is built with at least two installation holes 74*h*, that are evenly around the central axis of the horizontal rectangular stand 70, which correspond to and are able to attach the holes 174*h*-1 of the cross brace member 174; a vertical rectangular stand 71 perpendicularly conjoins to an edge of the horizontal rectangular stand 70 and opens to at least two slots 80 to conjoin at least two semi-hollow cylinders 81 which extend to the edge of the horizontal rectangular stand 70, the at least two semi-hollow cylinders 81 placed perpendicularly from the upper surface of the rectangular stand 70; a built in screw pole 65 placed to the center of each semi-hollow cylinder 81 and perpendicularly positioned from the upper surface of the rectangular stand 70; a reinforced strength spring 73 placed on each screw pole 65 positioned as the same central axis of the screw pole 65.

The at least two edge fixtures 001 are each comprised at least one top cover 69 configured a top horizontal rectangular stand 68 substantially similar to the horizontal rectangular stand 70, at least two built in semi-cylinders 82 extended to and positioned evenly from a central axis of an edge of the horizontal rectangular stand 68, at least two built in threaded holes 76 are each positioned the same central axis as the semi-cylinders 82, at least two built in flanges 72A are each positioned at the bottom surface of the top horizontal rectangular stand 68 corresponding to the flanges 72 of the horizontal rectangular stand 70; the top cover 69 can be moved up or down along the slots 80 tightened with at least two screw poles 65 and at least two bolts 77. Each edge fixture 001 comprises at least four rubber flanges 73 or 73A that each can be fitted and bound with glue 73*g* into the flange 72 or 72A. The at least two sides of the at least one solar panel 79 mounted between the rubber flanges 73A of the top covers and the rubber flanges 73 of the pedestals. The at least two edge fixtures install or assemble with angle aluminum or angle aluminum alloy or angle iron or angle steel of cross brace members 174 and/or the frame members 170 and 170-1 as shown in FIG. 6, FIG. 6 *a-a*, FIG. 7 and FIG. 7 *d-d*.

The third example of embodiment shows that the at least two cross brace members and the at least two frame members are each can be used standardizing or special made angle aluminum or angle aluminum alloy or angle iron or angle steel etc.

At least two frame members 170 or 171 are each parallel positioned on a side of a thin film solar panel or crystal silicon solar panel 79, and at least two cross brace members 174 are each parallel positioned and perpendicularly connected the at least two frame members 170 or 171 at each corner of the at least one solar panel 79. Each frame member 170 or 171 is configured to at least one hole 170*h* or 171*h* at each corner of the at least one solar panel 79, and trimmed a desired angle 170*a* at both ends or one end of the frame member 170 or 171. The at least two cross brace member 174 are each configured to at least one hole 174*h* that correspond to each corner of the at least one solar panel 79, at least one set of fasteners 170*s* including a screw and a bolt tightened through the hole 174*h* of the cross brace member 174 which is positioned at the top of a half first joint 185 which identified by a junction axis N, at least one hole 173*h* of a half first bent angle plate 173, the at least one hole 170*h* of the frame member 170, and at least one hole 173*h* of a half second bent angle plate 173 which is located at bottom of the half first joint 185. The two bent angle plates 173 at the first joint 185 which matches the same angle as formed by the two frame members 170 or 170 and 171, each bent angle plate 173 is placed at least one hole 173*h* on opposite of a junction axis N which correspond to two corners of the solar panels 79. At each of second joints 185-1, at least one set of fastener including a screw and a bolt perpendicularly tighten through the at least one hole 174*h* of the cross brace member which placed at top of the second joint 185-1, at least one hole 173*h*-1 of a first flat plate 173-1, the at least one hole 170*h*-1 of the frame member 170-1. At least one hole 173*h*-1 of a second flat plate 173-1 is an optional to attach at the bottom of the second joint 185-1.

Since this example of embodiment selected to use angle frame member and/or angle cross brace member, it is an option to configure at least one hole 190*h* on a vertical side of the angle frame member 170 at the half first joint 185, at least two flat plates 180 are each configured with at least one hole 180*h* opposite of junction axis N, corresponding to the at least one hole 190*h* of the vertical side of the angle frame members 170, at least one set of fastener 180*s* including a screw and a bolt tighten through the at least one hole 180*h* of the half first vertical flat plate 180 which identified by the junction axis N, the at least one hole 190*h* of the angle frame member, the at least one hole 180*h* of the half second vertical flat plate 180.

The at least two cross brace members 174 are each including at least two installation holes 174*h*-1 placed evenly around the central axis of the cross brace member 174 which correspond to at least two installation holes 74*h* of the pedestal 75. At least two sets of fasteners 174*s* are each included a screw and a bolt to tighten through each hole 74*h* of the pedestal 75 and the hole 174*h* of the cross brace member 174. The at least two sets of the pedestals 75 are parallel to each other positioned on both sides of the at least one solar panel 79 installed on one of the two cross brace members 174 and clipped to the two sides of the at least one solar panel 79 through the flanges 73, 72 and 73A, 72A and pressured by the top covers 69, tightened by the screw poles 65 and bolts 77, reinforcing strength by the springs 73.

Referring FIG. 8, FIG. 9, FIG. 10, FIG. 11 and FIG. 12 *p-p*, a fourth example of an embodiment of corner fixtures installation or assembly comprised of at least one thin film solar panel or crystalline silicon solar panel 479, at least four sets of corner fixtures 002 which are designed to clip generally each corner of the at least one solar panel 479, and a configuration of holes to support members of at least two cross brace and at least two frames, and include a plurality of secure members such as plates and fasteners according to the invention.

The at least four sets of corner fixtures 002 are each configured a corner pedestal 375 which can be made by casting mold that can use materials of aluminum or aluminum alloys, or can be made by injection molding which can use material of plastics, etc. The corner pedestal 375 configures two identical horizontal rectangular stands 330 conjoined at the ends to form a ninety degree angle built in at least two flanges 332 with a design size about ⅓ high×diameter ⅓ inch but it can be designed with different sizes; each of the flanges 332 can be shaped as a cylinder or square or rectangularity that is placed opposite to a corner axis C on the upper surface of each horizontal rectangular stand 330; each rectangular stand 330 is built with at least one installation hole 375*h* which is positioned evenly from the corner axis C that can be attached or installed with an additional support members or structure on the ground or roofs of buildings etc; two identical vertical rectangular stands 331 perpendicularly conjoined to one end while perpendicularly conjoined to the edges of the horizontal rectangular stands 330 to form a corner; each of the two vertical rectangular stands 331 opened to at least one slot 320 to conjoin to at least one semi-hollow cylinder 341 which extends to an edge of each horizontal rectangular stand of 330, at least two semi-hollow cylinders 341 placed perpendicularly from the upper surface of the horizontal rectangular stands 330; a built in screw pole 345 placed to the center of each semi-hollow cylinder 341 and perpendicularly from the upper surface of the horizontal rectangular stand 330; each screw pole 345 placed into a spring 343 which can be reinforced by tightening strength, pressured by a top cover 369 which can be moved up or down along the slots 320 and fasten with the screw poles 345 with bolts 337. Each of the corner pedestals 375 are configured with at least two rubber flanges 333 which are placed perpendicularly on the upper surface of the corner horizontal stand 330, positioned opposite of the corner axis C, the rubber flanges 333 placed to be fitted and bound with glue 333*g* into the flange 332.

The at least four corner fixtures 002 are each configured to a top corner cover 369 that can be made by casting mold using materials of aluminum or aluminum alloys, or can be made by injection molding using plastics materials configuring two identical top rectangular stands 338 that are substantially similar to the horizontal rectangular stand 330 perpendicularly conjoined to one end to form a ninety degree angle while conjoined to at least one mate semi-cylinder 342 to the opposite of the corner axis C, the size of the semi cylinder 342 approximately equals or slightly smaller than an inner diameter of the semi-hollow cylinder 341 of the corner pedestal 375. A built in full round hole 336 positioned to the same central axis of the semi-cylinders 342 that can be fitted into each of the screw poles 345 of the pedestal 375. The top corner cover 369 built in at least two flanges 332A which is placed at the bottom surface of the top rectangular stand 338 designed with the same size as the flange 332 of the horizontal rectangular stand 330 about ⅓ high×diameter ⅓ inch but which can be designed with a different size; the flanges 332A can be cylinder or square or rectangular that place to the same central axis and parallel to and corresponding to the flanges 332 of the horizontal rectangular stand 330. Each of the top corner cover 369 comprises at least two rubber flanges 333A are each designed a slightly bigger size than the flange 332A and to be fitted and bound with glue 333*g* into each of flange 332A. The at least one solar panel mounted between the rubber flanges of the top covers and the rubber flanges of the pedestals at each corner of the at least one solar panel 79.

At least two frame members 370 or 390 are each parallel positioned on a side of at least one thin film solar panel or crystal silicon solar panel 479, and at least two cross brace members 374 are perpendicularly to connect the at least two frame members at each corner of the at least one solar panel 479. Each frame member 370 or 370-1 configures at least one hole 370*h* at each corner of the at least one solar panel 479, and trimmed a desired angle 370*a* at both ends or one end of the frame member 370 or 370-1. The at least two cross brace member 374 are each configured at least one hole 374*h* that correspond to each corner of the at least one solar panel 479, at least one set of fastener 370*s* including a screw and a bolt tightened through the hole 374*h* of the cross brace member 374 which is positioned at the top of a half first joint 385 which identified by junction axis N, at least one hole 373*h* of a half first bent angle plate 373, the at least one hole 370*h* of the frame member 370, at least one hole 373*h* of a half second bent angle plate 373 which is located at bottom of the half first joint 385. The two bent angle plates 373 at the first joint 385 which matched the same angle as formed by the at least two frame members 370 or the at least two frame members 370 and 370-1, each bent angle plate 373 placed the at least one hole 373*h* on opposite of a junction axis N which correspond to two corners of two solar panels 479. At each of second joints 385-1, at least one set of fastener 370*s*-1 including a screw and a bolt perpendicularly tighten through the at least one hole 374*h* of the cross brace member 374 which positioned at top of the second joint 385-1, at least one hole 410*h* of a first flat plate 410, the at least one hole 370*h*-1 of the frame member 370-1. At least one hole 410*h* of a second flat plate 410 is an optional to attach at the bottom of the second joint 285-1.

The at least two cross brace members 374 are each placed at least one installation hole 374*h*-1 generally around the corner axis C of each corner pedestal 375, to correspond one of installation holes 375*h* of each corner pedestal 375, the at least two frame members 370 are each placed at least one installation hole 380*h* at opposite of the corner axis C of each corner pedestal 375, to correspond at least one other installation hole 375*h* at each corner of the pedestal 375, which correspond to each corner of the at least one solar panel 479. A flat liner plate 400 installed underneath of two corner pedestals 375 and upper surface of the frame member 370 or 390 for adjusting the high level that equals to the first bent angle plate 373 and the cross brace member 374 combined, referring FIG. 12*p-p*. A set of fastener 374*s* including a screw and a bolt to tighten through the hole 375*h* of the corner pedestal 375 and the hole 374*h*-1 of the cross brace member 374, and a set of fastener 400*s* tighten through the hole 375*h* of the corner pedestal 375, the hole 400*h* of the flat liner plate 400 and the hole 380*h* of the frame member 370 or the hole 390*h* of the frame member 390.

The at least four sets of the corner pedestals 375 are parallel to each other positioned at each corner of the at least one solar panel 479 which are installed on the at least two cross brace members 374 and the at least two frame members 370 or 390 generally clipped each corner of the at least one solar panel 479 through the flanges 333, 332 and 333A, 332A and pressured by the top covers 369, tightened by the screw poles 345 and bolts 337, reinforced strength by the springs 343.

The fourth example of embodiment shows that the at least two cross brace members and the at least two frame members are each can be shaped as polygon such as rectangular or square or six sides polygon. According to the invention each of the cross brace member or frame member can use standardizing or special made angle aluminum or angle aluminum alloy or angle iron or angle steel etc.

The preferred embodiments of the edge fixtures and installations with various frame members and cross brace members show in the first, the second and the third examples of embodiments above which may use less material to make the edge fixtures and fewer procedures to install. The fourth example, embodiment of the corner fixtures and installations may suit rough weather such as severe wind or snow or even hail. The preferred embodiments of the edge fixtures and installations and the embodiment of the corner fixtures and installations are suited for installation of at least one thin file solar panel or crystalline silicon solar panel. Both the edge fixtures and the corner fixtures are suited to install with the cross brace members and the frame members that shaped as polygon such as rectangular or square or six sides polygon, or use standardizing or special made angle aluminum or angle aluminum alloy or angle iron or angle steel etc., according to the invention.

The above description with accompanying drawings of examples in the figures should be construed in an illustrative sense and not limit the scope of the present invention. The Figs. of the drawings are for demonstration and description purposes, since the actual appearances of the solar panel fixtures and support members may differ from the Figs. of the drawings herein. Certain changes may be made in the foregoing disclosure but are not intended to depart from the scope of the invention.

I claim:

1. Solar panel edge fixtures and installations comprising:

a. at least one solar panel;

b. at least two sets of edge fixtures are each parallel positioned and clipped to an edge of the at least one solar panel, each set of the edge fixtures comprise a pedestal including at a horizontal rectangular stand built with at least two flanges placed evenly around a central axis and positioned at the upper surface of the rectangular stand which is built with at least two installation holes; a vertical rectangular stand perpendicularly conjoins to an edge of the horizontal rectangular stand and opens at least two slots to conjoin to at least two semi-hollow cylinders which extend to the edge of the horizontal rectangular stand, the at least two semi-hollow cylinders are each placed perpendicularly from the upper surface of the rectangular stand and positioned around the central axis of the horizontal rectangular stand; a built in screw pole placed to the center of each semi-hollow cylinder and perpendicularly positioned from the upper surface of the rectangular stand; wherein the pedestal includes at least two rubber flanges that are each to be fitted and bound with glue into each of the built in flanges;

wherein the at least two sets of the edge fixtures are each comprising a top cover including at a top horizontal rectangular stand, at least two built in semi-cylinders extend to and are each positioned from a central axis of the horizontal rectangular stand, at least two built in threaded holes are each positioned at the same central axis as the semi-cylinders, at least two built in flanges are each positioned at the bottom surface of the top horizontal rectangular stand aligned at the same central axis of each flange of the horizontal rectangular stand of the pedestal;

wherein the top cover includes at least two rubber flanges that are each to be fitted and bound with glue into each of the built in flanges, the at least one solar panel mounted between the rubber flanges of the top covers and the rubber flanges of the pedestals at least two sides of the at least one solar panel, the top cover is capable to move up or down along the slots to tighten the solar panel with the screw poles and bolts;

c. i) at least two frame members are each configured generally to at least one hole at each corner of the at least one solar panel and trimmed a desired angle at both ends of the frame member, wherein the at least two frame members are each parallel positioned to a side of the at least one solar panel, and at least two cross brace members are each configured generally to at least one hole at each corner of the at least one solar panel and perpendicularly connect to the at least two frame members, attached by a half first angle plate and a half second angle plate identified by a junction axis N at each first joint, at least one set of fasteners including a screw and a bolt tightened through the at least one hole of the cross brace member which positioned at the top half of the first joint, at least one hole of the half first bent angle plate, at least one hole of the frame member, and at least one hole of the second half bent angle plate which is located at the bottom of the first half joint; and ii). at least two frame members are each configured generally to at least one hole at each corner of the at least one solar panel and trimmed a desired angle at one end of the frame member, wherein the at least two frame members are each parallel positioned to a side of the at least one solar panel, and at least two cross brace members are each configured at least one hole at each corner of the at least one solar panel and perpendicularly connected to the at least two frame members at ends which are trimmed at angles, attached by the other half first angle plate and other half second angle plate identified by a junction axis N at each first joint, at least one set of fasteners including a screw and a bolt tightened through the at least one hole of the cross brace member which is positioned at the top other half of the first joint, at least one hole of the other half first bent angle plate, the at least one hole of the frame member, and at least one hole of the other second half bent angle plate which is located at the bottom of the other half first joint;

wherein the at least two cross brace members connected to the at least two frame members at ends without trimming angles at each of second joints which tightened by at least one set of fasteners including a screw and a bolt, through the hole of the cross brace member which is positioned at top of the second joint, the hole of a flat plate, and the hole of the frame member;

wherein the at least two cross brace members are each configured to at least two installation holes placed around a central axis of the cross brace member which correspond to the at least two installation holes of each pedestal, at least one set of fastener included a screw and a bolt to tighten through the hole of the pedestal and the hole of the cross brace member, the at least two sets of the edge fixtures clipped to two sides of the at least one solar panel through the flanges and pressured by the top covers, tightened by the screw poles and bolts.

2. The solar panel edge fixtures and installations of claim 1, wherein said pedestal and said top cover of the edge fixture made by casting mold that uses materials of aluminum or aluminum alloys.

3. The solar panel edge fixtures and installations of claim 1, wherein said pedestal and top cover of the edge fixture made by injection molding uses plastic materials.

4. The solar panel edge fixtures and installations of claim 1, wherein said the at least one solar panel further including a thin film or crystalline silicon solar panel.

5. The solar panel edge fixtures and installations of claim 1, further including a reinforced strength spring placed on each screw pole positioned at the same central axis of the screw pole.

6. The solar panel edge fixtures and installations of claim 1, wherein said the at least two cross brace member are shaped as polygon.

7. The solar panel edge fixtures and installations of claim 1, wherein said the at least two cross brace members use angle aluminum or angle aluminum alloy or angle iron or angle steel.

8. The solar panel edge fixtures and installations of claim 1, wherein said the at least two frame members members are shaped as polygon.

9. The solar panel edge fixtures and installations of claim 1, wherein said the at least two frame members use angle aluminum or angle aluminum alloy or angle iron or angle steel.

10. Solar panel edge fixtures and installations comprising:

a. at least one solar panel;

b. at least two sets of edge fixtures are each parallel positioned and clipped to an edge of the at least one solar panel, each set of the edge fixtures comprise a pedestal configured at a horizontal rectangular stand built with at least two flanges placed evenly around a central axis and positioned at the upper surface of the rectangular stand which is built with at least two installation holes; a vertical rectangular stand perpendicularly conjoins to an edge of the horizontal rectangular stand and opens at least two slots to conjoin to at least two semi-hollow cylinders which extend to the edge of the horizontal rectangular stand, the at least two semi-hollow cylinders are each placed perpendicularly from the upper surface of the rectangular stand and positioned around the central axis of the horizontal rectangular stand; a built in screw pole placed to the center of each semi-hollow cylinder and perpendicularly positioned from the upper surface of the rectangular stand; wherein the pedestal includes at least two rubber flanges that are each to be fitted and bound with glue into each of the built in flanges;

wherein the at least two sets of the edge fixtures are each comprising a top cover configured at a top horizontal rectangular stand, at least two built in semi-cylinders extend to and are each positioned from a central axis of the horizontal rectangular stand, at least two built in threaded holes are each positioned at the same central axis as the semi-cylinders, at least two built in flanges are each positioned at the bottom surface of the top horizontal rectangular stand aligned at the same central axis of each flange of the horizontal rectangular stand of the pedestal;

wherein the top cover includes at least two rubber flanges that are each to be fitted and bound with glue into each of the built in flanges, the at least one solar panel mounted between the rubber flanges of the top covers and the rubber flanges of the pedestals at least two sides of the at least one solar panel, the top cover is capable to move up or down along the slots to tighten the solar panel with the screw poles and bolts; and c. at least two frame members are each configured at least one hole generally at each corner of the at least one solar panel, are each parallel positioned to a side of the at least one solar panel, and at least two cross brace member are each configured at least one hole generally at each corner of the at least one solar panel and perpendicularly attach to the at least two frame members, tightened by at least one set of fasteners including a screw and a bolt through the at least one hole of the cross brace member and at least one hole of the frame member at each corner of the at least one solar panel;

wherein the at least two cross brace members are each configured to at least two installation holes placed around a central axis of the cross brace member which correspond to at least two installation holes of each pedestal which is parallel to each other positioned on both sides of the at least one solar panel, at least four sets of fasteners are each included a screw and a bolt to tightened through the holes of the at least two sets of the pedestals and the holes of the at least two cross brace members, and clipped to the two sides of the at least one solar panel through the flanges and pressured by the top covers, tightened by the screw poles and bolts.

11. The solar panel edge fixtures and installations of claim 10, wherein said pedestal and said top cover of the edge fixture made by casting mold that uses materials of aluminum or aluminum alloys.

12. The solar panel edge fixtures and installations of claim 10, wherein said pedestal and said top cover of edge fixture made by injection molding uses plastic materials.

13. The solar panel edge fixtures and installations of claim 10, wherein said the at least one solar panel further including a thin film or crystalline silicon solar panel.

14. The solar panel edge fixtures and installations of claim 10, further including a reinforced strength spring placed on each screw pole positioned at the same central axis of the screw pole.

15. The solar panel edge fixtures and installations of claim 10, wherein said the at least two cross brace member are shaped as polygon.

16. The solar panel edge fixtures and installations of claim 10, wherein said at least two cross brace members use angle aluminum or angle aluminum alloy or angle iron or angle steel.

17. The solar panel edge fixtures and installations of claim 10, wherein said at least two frame members are shaped as polygon.

18. The solar panel edge fixtures and installations of claim 10, wherein said at least two frame members use angle aluminum or angle aluminum alloy or angle iron or angle steel.

19. The solar panel edge fixtures and installations of claim 10, wherein said at least one solar panel installed on the supporting members which is raised at a desired angle including horizontal level.

20. Solar panel corner fixtures and installations comprising:

a. at least one solar panel;

b. at least four sets of corner fixtures which are each parallel positioned and generally clipped to each corner of the at least one solar panel, wherein the at least four sets of the corner fixtures are each configured at a corner pedestal that included two horizontal rectangular stands conjoined at the ends to form a ninety degree angle built in at least two flanges that are each placed opposite to a corner axis C on the upper surface of each horizontal rectangular stand, which is built with at least one installation hole that is evenly positioned from the corner axis C, two vertical rectangular stands perpendicularly conjoined to each other at one end while perpendicularly conjoined to the edges of the horizontal rectangular stands to form a corner;

wherein the two vertical rectangular stands are each opened at least one slot to conjoin to at least one semi-hollow cylinder which extends to and perpendicularly from the upper surface of the horizontal rectangular stands; a built in screw pole placed to the center of each semi-hollow cylinder and perpendicularly from the upper surface of the horizontal rectangular stand;

wherein the corner pedestal is built with at least two flanges that are each placed on the upper surface of the corner horizontal stand positioned opposite of the corner axis C, at least two rubber flanges that are each to be fitted and bound with glue into the flange;

wherein the at least four sets of the corner fixtures are each included a top corner cover configured to two top rectangular stands perpendicularly conjoined to one end to form a ninety degree angle while conjoined to at least one mate semi-cylinder that positioned opposite of the corner axis C, a built in full round hole positioned to the same central axis of the semi-cylinders which is fitted into each of the screw poles of the corner pedestal; at least two built in flanges are each placed at the bottom surface of the top rectangular stand, and corresponding to the flanges of the horizontal rectangular stand of the corner pedestal, at least two rubber flanges are each to be fitted and bound with glue into each of the flanges of the top corner cover, the at least one solar panel mounted between the rubber flanges of the top corner covers and the rubber flanges of the corner pedestals at each corner of the at least one solar panel; and c. i) at least two frame members are each configured generally to at least one hole at each corner of the at least one solar panel and trimmed at an angle at both ends of the frame member, wherein the at least two frame members are each parallel positioned to a side of the at least one solar panel, and at least two cross brace members are each configured generally to at least one hole at each corner of the at least one solar panel and perpendicularly connect to the at least two frame members, attached by a half first angle plate and a half second angle plate identified by a junction axis N at each first joint, at least one set of fastener including a screw and a bolt tightened through the at least one hole of the cross brace member which positioned at the top half of the first joint, at least one hole of the half first bent angle plate, at least one hole of the frame member, and at least one hole of the second half bent angle plate which is located at the bottom of the first half joint; and ii). at least two frame members are each configured generally to at least one hole at each corner of the at least one solar panel and trimmed a desired angle at one end of the frame member, wherein the at least two frame members are each parallel positioned to a side of the at least one solar panel, and at least two cross brace member are each configured at least one hole at each corner of the at least one solar panel and perpendicularly connected to the at least two frame members at ends which are trimmed at angles, attached by the other half first angle plate and other half second angle plate identified by a junction axis N at each first joint, at least one set of fasteners including a screw and a bolt tightened through the at least one hole of the cross brace member which is positioned at the top other half of the first joint, at least one hole of the other half first bent angle plate, the at least one hole of the frame member, and at least one hole of the other second half bent angle plate which is located at the bottom of the other half first joint;

wherein the at least two cross brace members connected to the at least two frame members at ends without trimming angles at each of second joints which tightened by at least one set of fasteners including a screw and a bolt, through the hole of the cross brace member which is positioned at top of the second joint, the hole of a flat plate, and the hole of the frame member;

d. the at least two cross brace members are each placed at least one installation hole to correspond one of installation holes of each corner pedestal, the at least two frame members are each placed at least one installation hole to correspond at least other installation hole at each corner of the pedestal, a flat liner plate installed underneath of two corner pedestals and upper surface of the frame member for adjusting the high level that equals to the half first bent angle plate and the cross brace member combined, a set of fasteners including a screw and a bolt to tighten through the hole of the corner pedestal and the hole of the cross brace member and a set of fastener tighten through the other hole of the corner pedestal, the hole of the flat liner plate and the hole of the frame member at each corner of the at least one solar panel.

21. The solar panel corner fixtures and installations of claim 20, wherein said corner pedestal and said top corner cover of the corner fixture made by casting mold that uses materials of aluminum or aluminum alloys.

22. The solar panel corner fixtures and installations of claim 20, wherein said corner pedestal and top corner cover of the corner fixture made by injection molding uses plastic materials.

23. The solar panel corner fixtures and installations of claim 20, wherein said the at least one solar panel further including a thin film or crystalline silicon solar panel.

24. The solar panel corner fixtures and installations of claim 20, further including a reinforced strength spring placed on each screw pole positioned at the same central axis of the screw pole.

25. The solar panel corner fixtures and installations of claim 20, wherein said the at least two cross brace member are shaped as polygon.

26. The solar panel corner fixtures and installations of claim 20, wherein said at least two cross brace members use angle aluminum or angle aluminum alloy or angle iron or angle steel.

27. The solar panel corner fixtures and installations of claim 20, wherein said at least two frame members member are shaped as polygon.

28. The solar panel corner fixtures and installations of claim 20, wherein said the at least two frame members use angle aluminum or angle aluminum alloy or angle iron or angle steel.

* * * * *